US007063537B2

(12) United States Patent
Selli et al.

(10) Patent No.: US 7,063,537 B2
(45) Date of Patent: Jun. 20, 2006

(54) ROTATABLE ASSEMBLIES AND METHODS OF SECURING SUCH ASSEMBLIES

(75) Inventors: Basilio Selli, Nesconset, NY (US); Geraldo Gullo, Sentaozinho (BR)

(73) Assignee: Smar Research Corporation, Holbrook, NY (US)

( * ) Notice: Subject to any disclaimer, the term of this patent is extended or adjusted under 35 U.S.C. 154(b) by 111 days.

(21) Appl. No.: 10/223,692

(22) Filed: Aug. 15, 2002

(65) Prior Publication Data

US 2004/0033704 A1 Feb. 19, 2004

(51) Int. Cl.
*H01R 39/00* (2006.01)

(52) U.S. Cl. ..... 439/21; 248/922

(58) Field of Classification Search ..... 439/8, 439/21–30; 248/919–922; 73/756
See application file for complete search history.

(56) References Cited

U.S. PATENT DOCUMENTS 1,435,421 A * 11/1922 Scharff ..... 439/21
2,313,481 A * 3/1943 Rendano ..... 416/100
2,416,802 A * 3/1947 Roung ..... 47/40.5
3,674,308 A * 7/1972 Radding ..... 297/344.2
3,975,050 A * 8/1976 McKee ..... 297/328
4,547,027 A 10/1985 Scheibenreif
4,687,167 A * 8/1987 Skalka et al. ..... 248/126
4,785,240 A * 11/1988 Newell et al. ..... 324/207.26
4,874,138 A 10/1989 Kettenring
5,028,746 A 7/1991 Petrich
5,043,543 A * 8/1991 Weeks et al. ..... 200/82 R
5,052,643 A * 10/1991 Law ..... 248/56
5,173,053 A * 12/1992 Swanson et al. ..... 439/27
5,178,546 A 1/1993 Dickerson
5,239,130 A * 8/1993 Brasse ..... 174/52.1
5,346,400 A * 9/1994 Shin ..... 439/17
6,370,020 B1 * 4/2002 Toukairin ..... 361/681
6,508,131 B1 * 1/2003 Frick ..... 73/756
2002/0000997 A1 1/2002 Selli et al.

* cited by examiner

*Primary Examiner*—Neil Abrams
(74) *Attorney, Agent, or Firm*—Dorsey & Whitney LLP

(57) ABSTRACT

A rotatable assembly and a method to use the same are provided. In particular, the assembly includes a first field device housing arrangement associated with a first electrical system, and a second field device housing arrangement associated with a second electrical system are connected by a connector arrangement. The connector arrangement may include probes (e.g., spring probes) that are adapted to engage with contacts (e.g., electrical contacts), and is configured to allow an unrestricted rotation of the first field device housing arrangement relative to the second field device housing arrangement while maintaining a continuous electrical coupling between the first electrical system and the second electrical system. For example, the assembly can be a field device, such as a smart field device. Two devices may be secured to one another by use of a captive locking screw which can be used to secure the first device in desired positions.

8 Claims, 8 Drawing Sheets

ROTATABLE ASSEMBLIES AND METHODS OF SECURING SUCH ASSEMBLIES

FIELD OF THE INVENTION

The present invention relates generally to assembly and method in which a first field device housing arrangement associated with a first electrical system is rotatable with respect to a second field device housing arrangement associated with a second electrical system using a connector arrangement. In particular, the present invention is directed to the assembly and method in which the connector arrangement is configured to allow an unrestricted rotation of the first field device housing arrangement relative to the second field device housing arrangement while maintaining a continuous electrical coupling between the first electrical system and the second electrical system.

BACKGROUND OF THE INVENTION

Conventional field devices, such as conventional smart field devices, may include a sensor housing and an electronics housing which are interconnected during their assembly. For example, the electronics housing may be connected to the sensor housing using electrical threads provided on a particular portion of the sensor housing and/or the electronics housing. Moreover, a sensor (e.g., a pressure sensor) and a circuit board which includes signal conditioning electronic components can be positioned inside the sensor housing. Similarly, a display unit and a circuit board which includes signal conditioning electronic components can also be provided within the electronics housings, such that a display of the display unit may be viewable by a user when the electronics housing is connected to the sensor housing. Further, the circuit board in the sensor housing is generally connected to the circuit board in the electronics housing by a cable. Consequently, the sensor may obtain measurements (e.g., pressure readings associated with a fluid), and data associated with the measurements may be displayed to the viewer.

In certain conventional field devices, such as those described in, e.g., U.S. Pat. No. 5,028,746 issued to Detrich, a first end of the cable is connected in a fixed manner to the circuit board positioned within the sensor housing, and the cable is wound in a helix around a protector assembly. After the sensor housing and the electronics housing of such field device are threaded together, a second end of the cable can be fished out through an opening and connected to the circuit board positioned within the electronics housing, thereby unwinding a portion of the cable. Moreover, the cable protector assembly can reduce the likelihood that the cable will become twisted or otherwise deformed during this connection, or disconnected from the circuit board which is situated within the sensor housing. After the second end of the cable has been connected to the circuit board positioned inside the electronics housing, the cable protector assembly may allow a user to adjust a position of the electronics housing relative to the sensor housing by rotating the electronics housing up to 720° without damaging the cable. For example, the electronics housing can be rotated so as to adjust a position of the display for the display to be more readily by viewed by the user. Nevertheless, if the electronics housing is rotated by more than 720°, the cable may become twisted or otherwise deformed, as well as become disconnected from the circuit board that is positioned inside the sensor housing. In addition, because the cable is wound and/or unwound during this adjustment, it is possible for the cable to become twisted or otherwise deformed at such time regardless of the extent that the electronics housing is rotated relative to the sensor housing.

SUMMARY OF THE INVENTION

Therefore, a need has arisen to provide a rotatable assembly (e.g., a field device) and method for assembling such assembly which overcome the above-described and other shortcomings of the related art.

One of the advantages of the present invention is that a first field device housing arrangement which is associated with a first electrical system is connected via a connector arrangement to a second field device housing arrangement which is associated with a second electrical system. Moreover, the connector arrangement is configured to allow an unrestricted rotation of the first field device housing arrangement relative to the second field device housing arrangement while maintaining a continuous electrical coupling between the first electrical system and the second electrical system. Further, there may be no need to facilitate internal cables or wires to be provided between the first field device housing arrangement and the second field device housing arrangement. In operation, when the first field device housing arrangement is rotated relative to the second field device housing arrangement, the electrical coupling between the first electrical system and the second electrical system is preferably prevented from being disrupted.

According to an exemplary embodiment of the present invention, an assembly includes a first field device housing arrangement (e.g., an electronics housing arrangement) which is associated with a first electrical system, a second field device housing arrangement (e.g., a sensor housing arrangement) which is associated with a second electrical system, and a connector arrangement. The connector arrangement is configured to allow an unrestricted rotation of the first field device housing arrangement relative to the second field device housing arrangement while maintaining a continuous electrical coupling between the first electrical system and the second electrical system. For example, the assembly can be a field device, such as a smart field device. The first electrical system may include a display unit and/or a first circuit fixture positioned inside the first field device housing arrangement, and the second electrical system can include a sensor unit and/or a second circuit fixture positioned inside the second field device housing arrangement. Alternatively, the second electrical system can be situated inside a third field device housing arrangement which is fixed to the second field device housing arrangement. The third field device housing arrangement can be positioned between the first field device housing arrangement and the second field device housing arrangement.

According to another exemplary embodiment of the present invention, the connector arrangement may include a locking system configured to fix the first field device housing arrangement to the second field device housing arrangement. The connector arrangement also can include at least one probe having a first end which is fixed to the first electrical system (e.g., to a first circuit fixture), and a second end which is electrically coupled to a contact area of the second electrical system (e.g., electrically coupled to a second circuit fixture). For example, an electrical contact can be provided at the second end of the probe. Moreover, the locking system may include at least one securing element (e.g., a bolt or a screw) adapted to secure the first field device housing arrangement to the second device housing arrangement, and which preferably includes a head portion.

For example, the first field device housing arrangement can include a passage, and the second field device housing arrangement may include a recess provided around a portion which is aligned with the passage. Alternatively, the third field device housing arrangement can include the recess which is aligned with the passage. In addition, the securing element can be positioned within the passage, and may contact the second field device housing arrangement or the third field device housing arrangement via the recess. The locking system can also include a cap element adapted to cover at least the head portion of the securing element.

In yet another embodiment of the present invention, the cap element may include a hole formed therethrough, and a cross-sectional area of the hole can be less than a cross-sectional area of the head portion of the at least one securing element. Thus, a tool element (e.g., an Allen Hex Tool) can be inserted through the hole in order to loosen the at least one securing element, with the cap element preventing the securing element from being removed from the passage. When the securing element is loosened, the first field device housing arrangement can be unrestrictedly rotated relative to the second field device housing arrangement. For example, a tip of the securing element may be at least partially disengaged from the second field device housing arrangement or the third field device housing arrangement without being entirely removed from the recess. Such positioning of the tip of the securing element can prevent the second field device housing arrangement from being entirely detached from the first field device housing arrangement when the first field device housing arrangement is rotated with respect to the second field device housing arrangement.

According to still another exemplary embodiment of the present invention, a method of securing the assembly may include the step of loosening the securing element (e.g., by rotating the securing element in a predetermined direction). The method also preferably includes the step of maintaining a continuous electrical coupling between the first electrical system and the second electrical system, while unrestrictedly rotating the first field device housing arrangement relative to the second field device housing arrangement. The method also includes the step of securing the first field device housing arrangement to the second field device housing arrangement after the first field device housing arrangement reaches a predetermined position relative to the second field device housing arrangement (e.g., by rotating the at least one securing element in a direction which is opposite to a predetermined direction).

BRIEF DESCRIPTION OF THE DRAWINGS

For a more complete understanding of the present invention, the needs satisfied thereby, and the objects, features, and advantages thereof, reference now is made to the following descriptions taken in connection with the accompanying drawings.

DETAILED DESCRIPTION

Figure 1A:
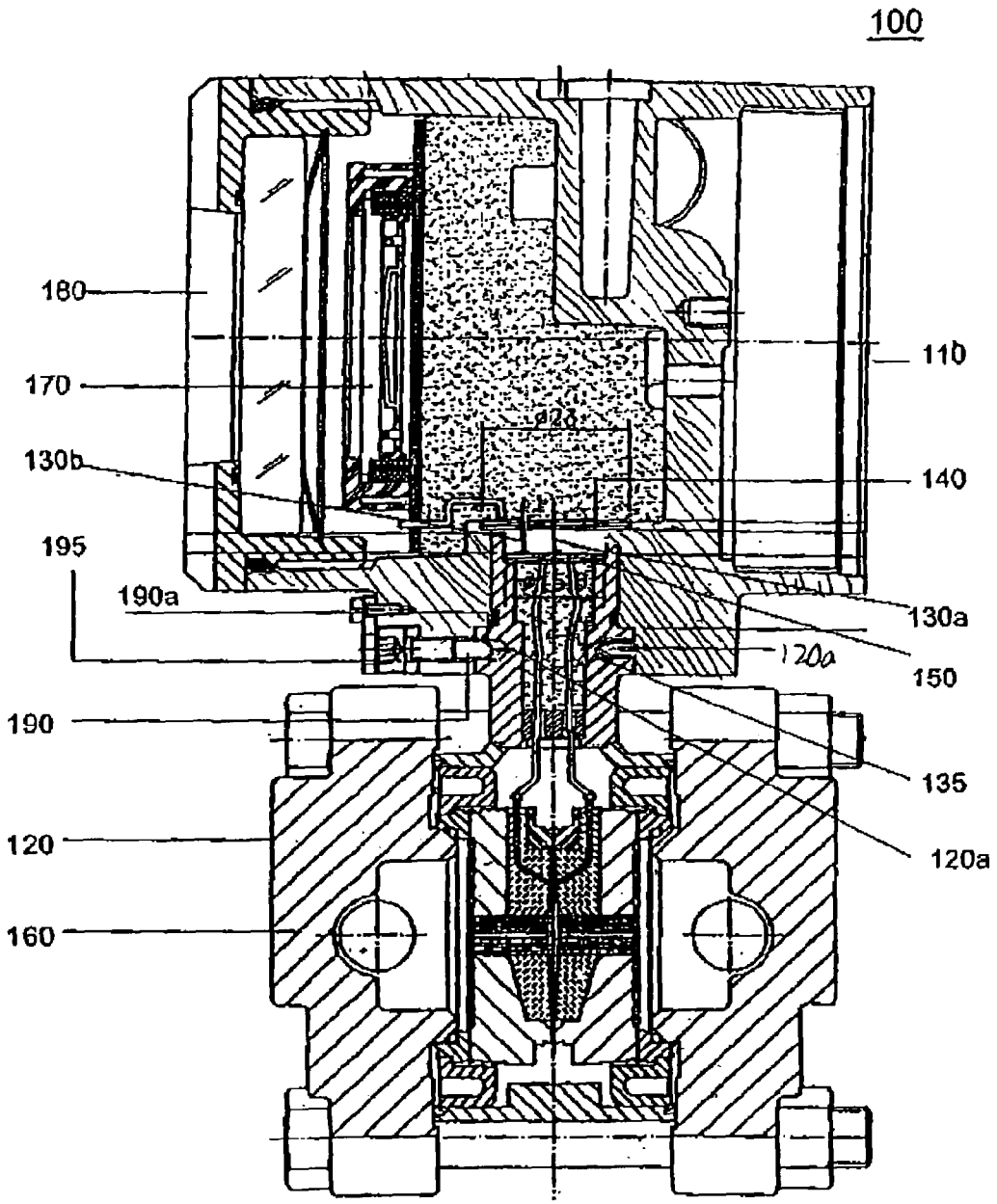
FIG. 1*a* is a cross-sectional view of a first exemplary embodiment of an assembly according to the present invention.

Exemplary embodiments of the present invention and their advantages may be understood by referring to FIGS. 1*a*–6, like numerals being used for like corresponding parts in the various drawings.

Referring to FIGS. 1*a*–4, a first exemplary embodiment of an assembly 100 (e.g., a field device, such as a smart field device) according to the present invention is provided. The assembly 100 may include a first field device housing arrangement 110 (e.g., an electronics housing arrangement) associated with a first electrical system, and a second field device housing arrangement 120 (e.g., a sensor housing arrangement) associated with a second electrical system. The first electrical system can include a display unit 170 and/or a first circuit fixture 140 (e.g., a metal plate) positioned inside the first field device housing arrangement 110. Moreover, the display unit 170 may include a display screen 180 which can be viewed by a user when the assembly 100 is in use. The display unit 170 can be electrically coupled to the first circuit fixture 140.

Similarly, the second electrical system may include a sensor unit 160 (e.g., a pressure sensor, a temperature sensor, etc.) and/or a second circuit fixture 150 (e.g., a metal plate) situated inside the second field device housing arrangement 120. Further, the sensor unit 160 can be electrically coupled to the second circuit fixture 150 via electrical connecting. For example, the second circuit fixture 150 may be situated inside a predetermined portion 135 of the second field device housing arrangement 120.

Figure 4:
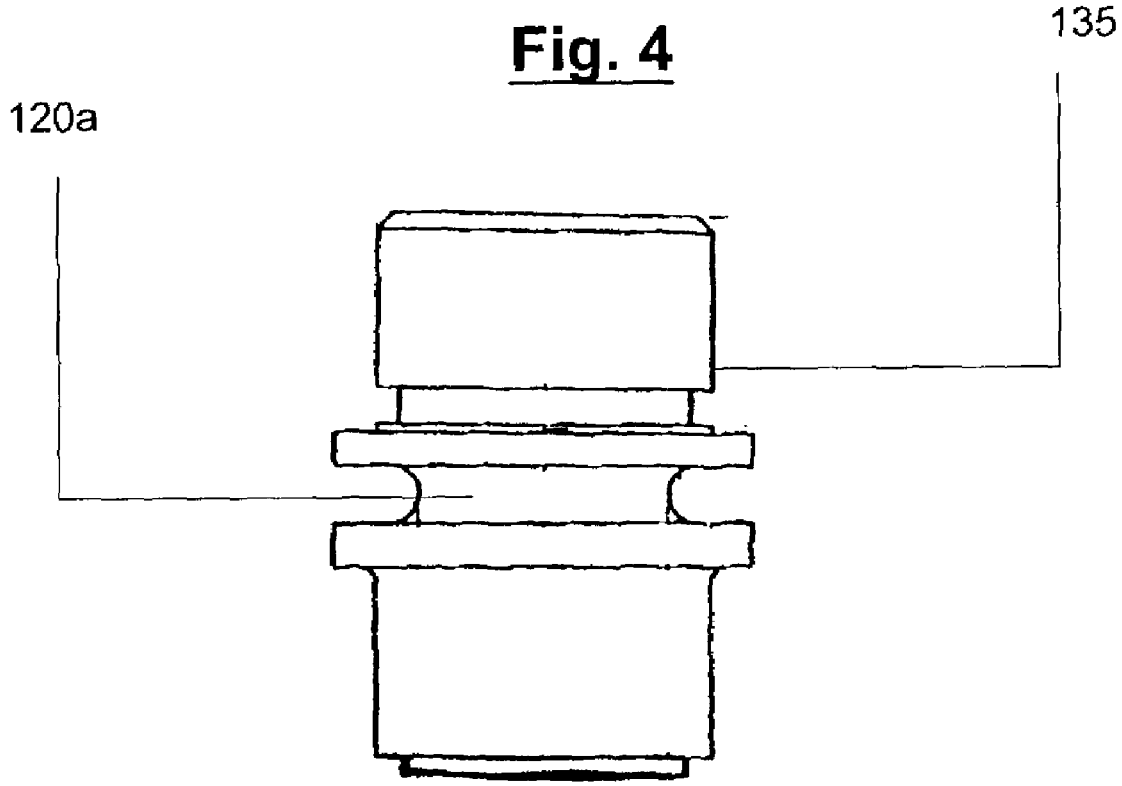
FIG. 4 is a cross-sectional enlarged view of a connecting arrangement or a portion of the second field device housing arrangement of the assembly shown in FIG. 1.

In operation, the sensor unit 160 may obtain measurements (e.g., a pressure measurement and/or a temperature measurement associated with a fluid), and data associated with such measurements may be displayed to the user via the display unit 170. Although the predetermined portion 135 is described as being a part of the second field device housing arrangement 120, it will be understood by those of ordinary skill in the art and as shown in FIG. 4, the predetermined portion 135 can be a separate third field device housing arrangement which is not formed integral with or a part of the second field device housing arrangement 120. In a variant of the first embodiment of the present invention, the second circuit fixture 150 can be situated inside the third field device housing arrangement, and the third field device housing arrangement may be positioned between the first field device housing arrangement 110 and the second field device housing arrangement 120.

The assembly 100 also may include a connector arrangement which may be formed from the second circuit fixture 150 and two electrical connectors or probes 130*a*, 130*b*. The connector arrangement is configured to allow an unrestricted rotation of the first field device housing arrangement 110 relative to the second field device housing arrangement 120 while maintaining a continuous electrical coupling between the first electrical system and the second electrical system. In addition, the connector arrangement may also include a locking system configured to fix the first field device housing arrangement 110 to the second field device housing arrangement 120, as well as a cap element 195. In an exemplary embodiment of the present invention and as shown in greater detail in FIG. 2, the locking system may include at least one securing element 190 (e.g., a bolt or a screw) adapted to secure the first field device housing arrangement 110 to the second field device housing arrangement 120, and which includes a head portion (not numbered in FIG. 1*a*). Moreover, the cap element 195 can be adapted to cover at least the head portion of the securing element 190.

Figure 3:
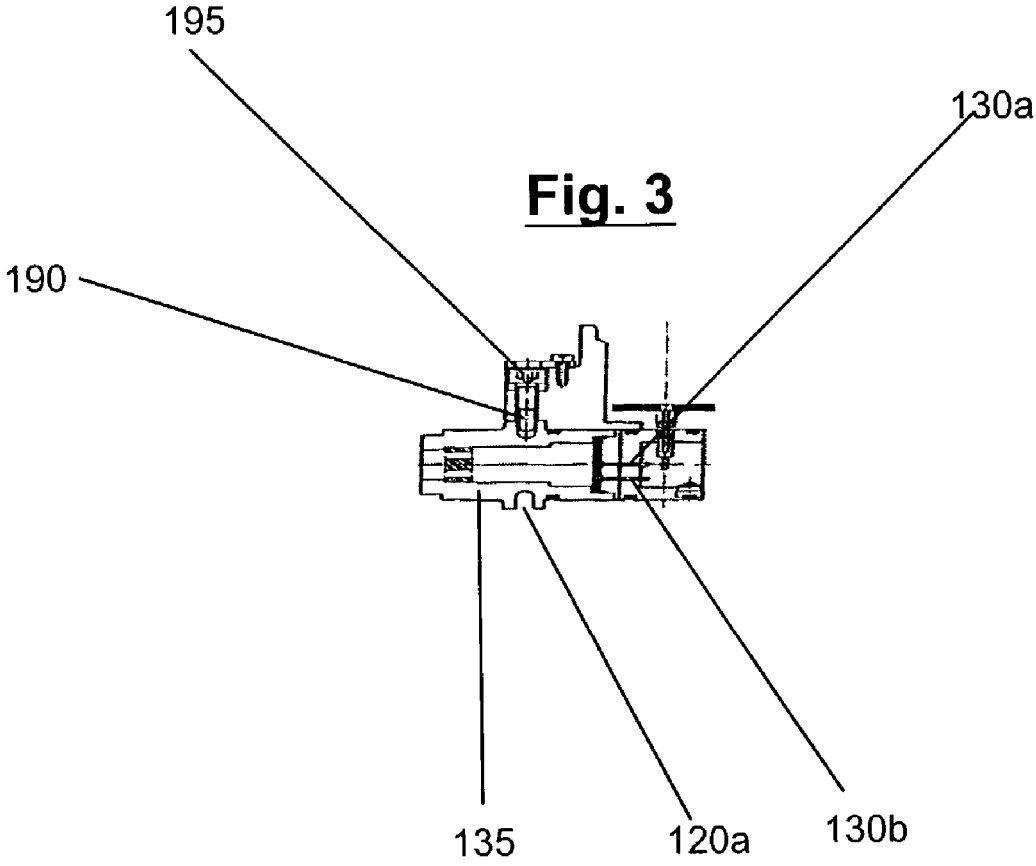
FIG. 3 is a cross-section view of an exemplary connector arrangement of the assembly shown in FIG. 1.

For example, referring now to FIGS. 1*a* and 4, the first field device housing arrangement 110 can include a passage (not numbered in these drawings), and the second field device housing arrangement 120 can include a recess 120*a* which is arranged around the predetermined portion 135, and is aligned with the passage. The securing element 190 can be positioned within the passage, and may contact the predetermined portion 135 of the second field device housing arrangement 120 via the recess 120*a*. Alternatively, in a variant of the first embodiment of the present invention, the recess 120*a* can be provided in the third field device housing arrangement, which may be connected to the second field device housing arrangement 120, and positioned between the first field device housing arrangement 110 and the second field device housing arrangement 120. In addition and as shown in FIG. 3, the cap element 195 may include a bore (not shown in the drawings) formed therethrough, and a cross-sectional area of the bore can be smaller than a cross-sectional area of the head portion of the securing element 190. As such, a tool element (e.g., an Allen Hex Tool) can be inserted through the bore in order to loosen the securing element 190, with the cap element 195 preventing the securing element 190 from being removed from the passage.

When the securing element 190 is loosened, the first field device housing arrangement 110 can be unrestrictedly rotated relative to the second field device housing arrangement 120. For example, as shown in FIG. 1*a*, when the securing element 190 is loosened, the securing element 190 moves in a direction that is opposite to the predetermined portion 135. As such, a tip 190*a* of the securing element 190 may begin to disengage from the predetermined portion 135. Moreover, in a preferred embodiment of the present invention, the tip 190 of the securing element 190 is not entirely removed from the recess 120*a*. As such, this tip 190*a* of the securing element 190 can prevent the second field device housing arrangement 120 from being entirely detached from the first field device housing arrangement 110 when the first field device housing arrangement 110 is rotated. Moreover, because the recess 120*a* is provided entirely around the predetermined portion 135, the first field device housing arrangement 110 can be secured to the second field device housing arrangement 120 after the rotation, independently from a position of the first field device housing arrangement 110 and relative to the second field device housing arrangement 120.

Figure 1B:
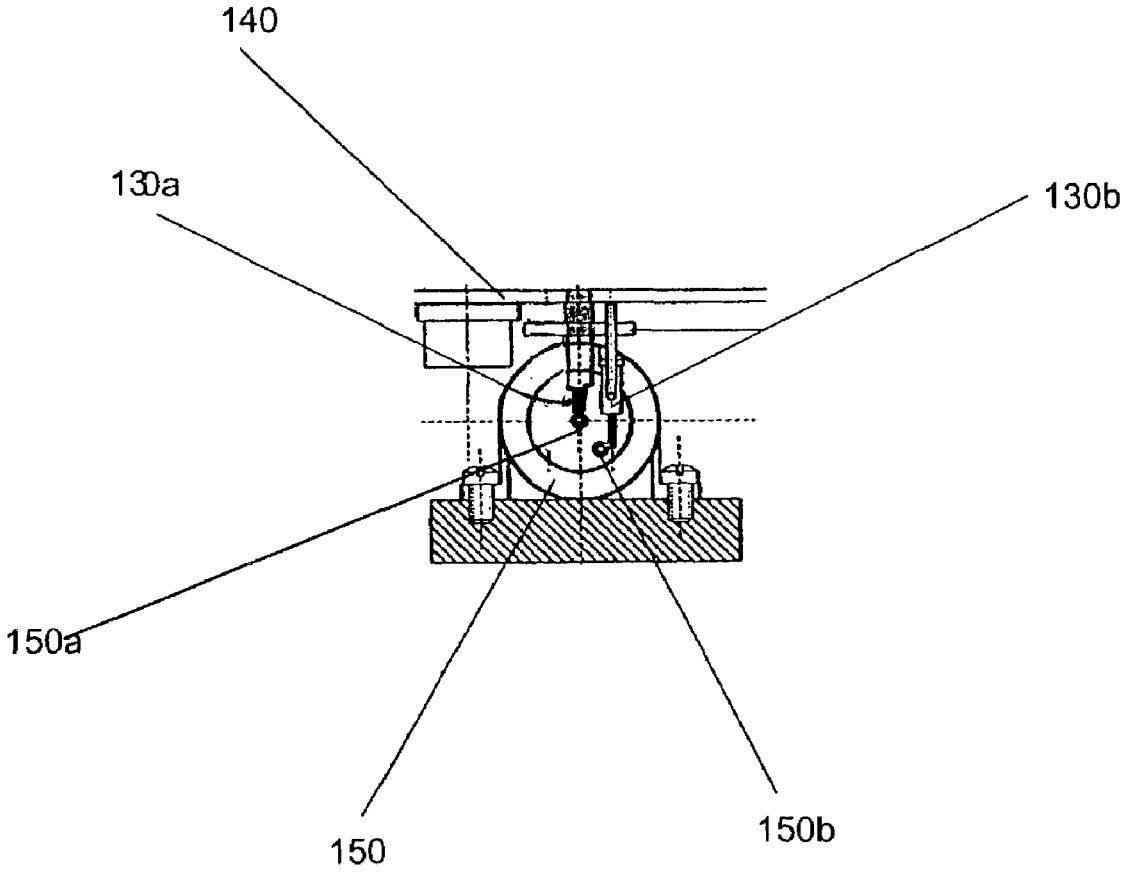
FIG. 1*b* is a schematic of a set of probes electrically coupling a first electrical system associated with a first field device housing arrangement to a second electrical system associated with a second field device housing arrangement provided within the assembly shown in FIG. 1*a*.
Figure 2:
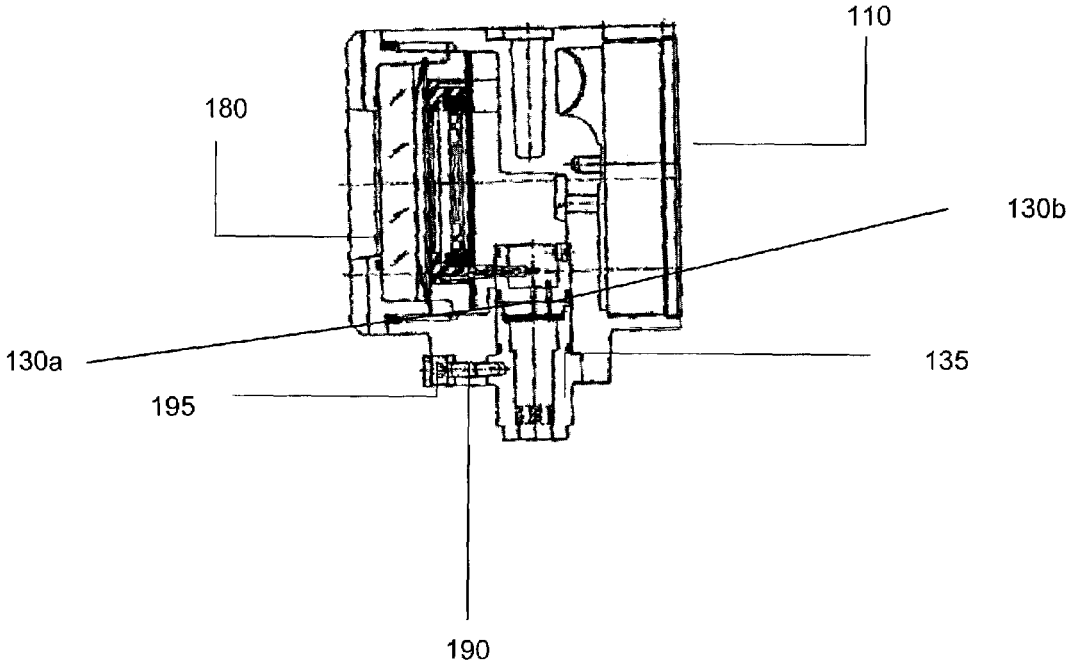
FIG. 2 is a cross-section view of an exemplary first field device housing arrangement of the assembly shown in FIG. 1.
Figure 5A:
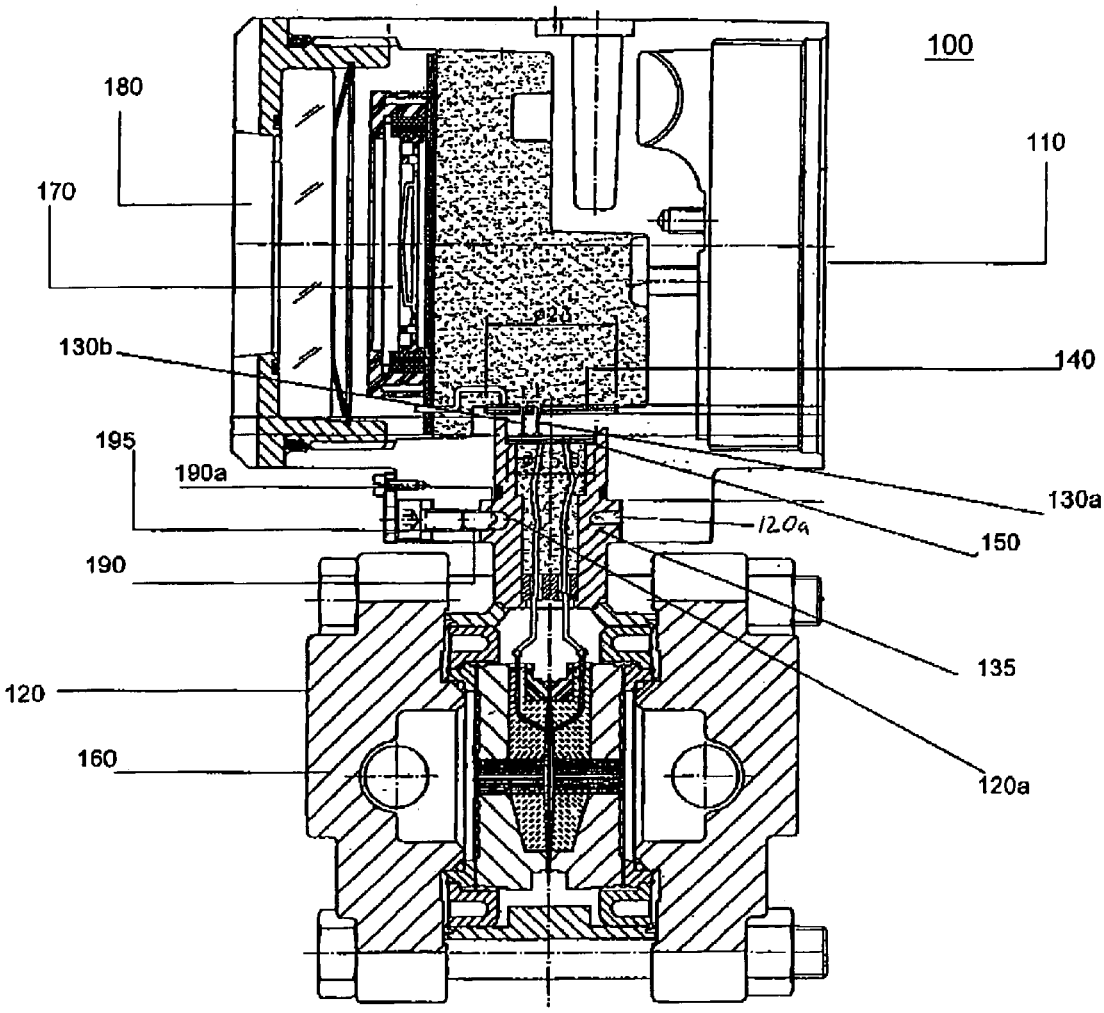
FIG. 5*a* is a cross-sectional view of a second exemplary embodiment of an assembly according to the present invention.
Figure 5B:
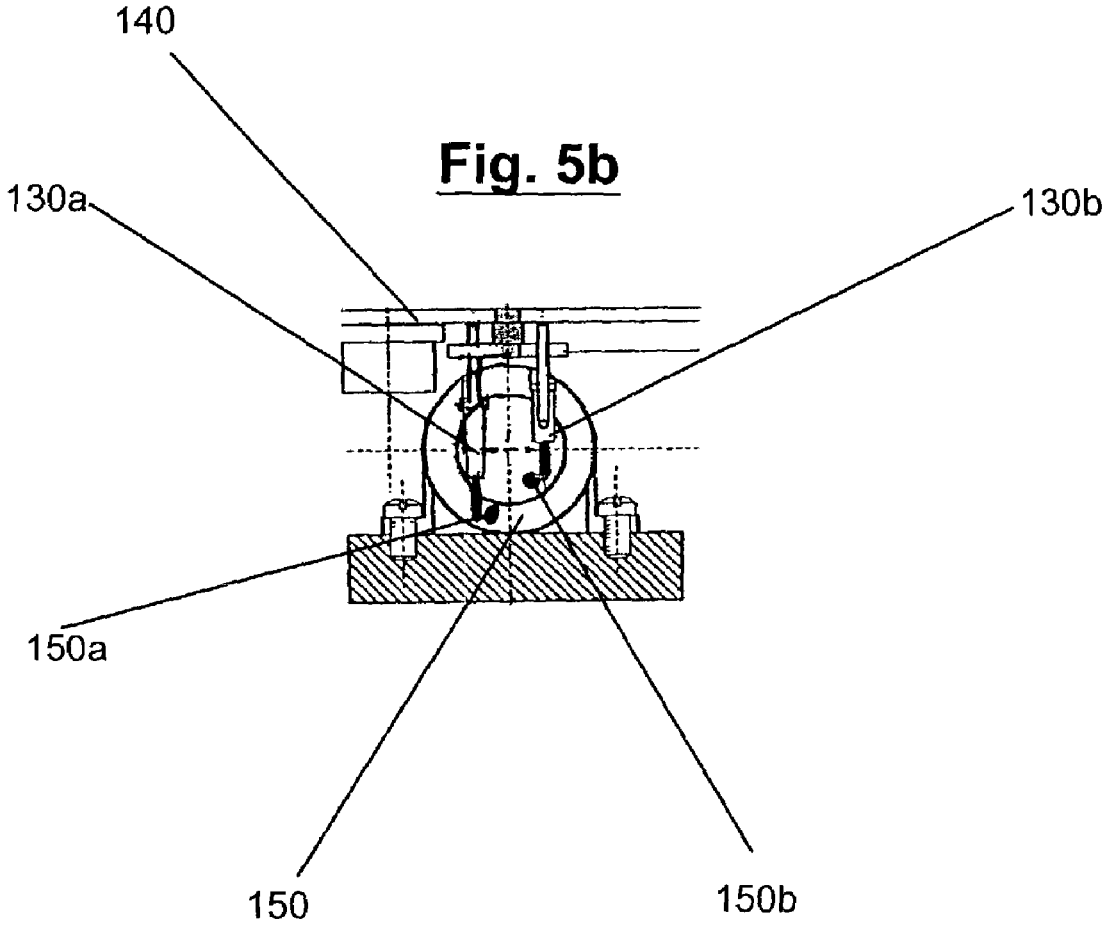
FIG. 5*b* is a schematic of a set of probes electrically coupling a first electrical system associated with the first field device housing arrangement to a second electrical system associated with the second field device housing arrangement provided within the assembly illustrated in FIG. 5*a*.
Figure 6:
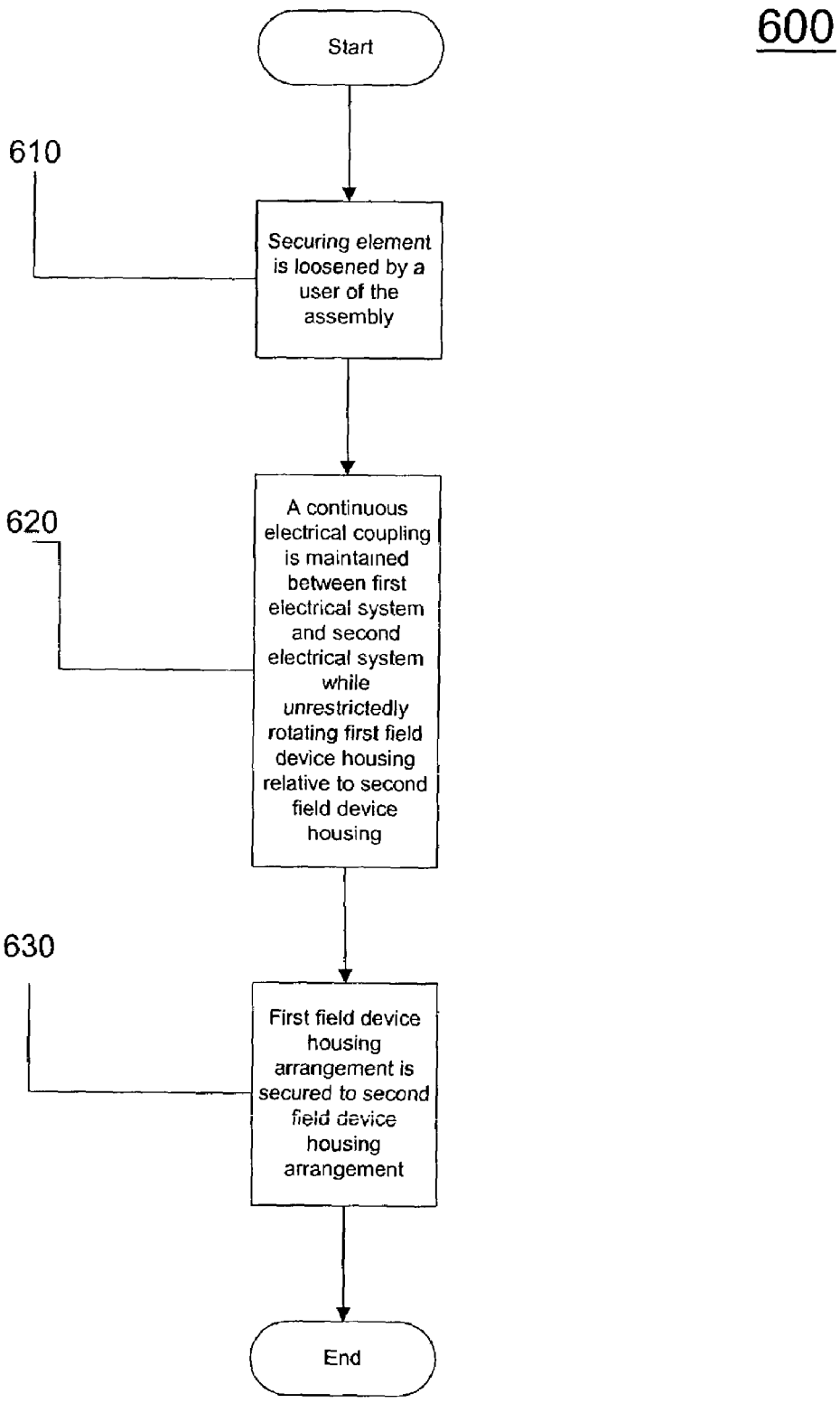
FIG. 6 is a flow diagram of an exemplary embodiment of a method according to the present invention for securing the assemblies is illustrated in FIGS. 1*a* and 5*a*.

Referring again to FIGS. 1*a*–4, the connector arrangement also can include at least one probe (e.g., at least one spring loaded probe), and preferably the first connector probe 130*a* and the second connector probe 130*b*. Moreover, current may flow from the first electrical system of the first field device housing arrangement 110 to the second electrical system of the second field device housing arrangement 120 via the first probe 130*a*. Also current can flow from the second electrical system to the first electrical system via the second probe 130*b*. Further, as shown in FIG. 1*b*, each of the probes 130*a*, 130*b* may have a respective first end which is fixed to the first electrical system (e.g., fixed to the first circuit fixture 140), and a second end which is electrically coupled to a contact area 150*a* or a contact area 150*b* of the second electrical system (e.g., electrically coupled to the contact area 150*a* or the contact area 150*b* of the second circuit fixture 150). For example, an electrical contact (not shown) can be provided at the second end of the respective probe 130*a*, 130*b*. The contact area 150*a* and/or the electrical contact area 150*b* can have a circular cross-sectional area, a square cross-sectional area, a rectangular cross-sectional area, a ring-shaped cross-sectional area, etc. Nevertheless, it will be understood by those of ordinary skill in the art that regardless of the shape of the contact area 150*a* or the contact area 150*b*, a surface area of the contact area 150*a* and/or the contact area 150*b* may be sized such that throughout the rotation of the first field device housing arrangement 110, the first probe 130*a* and the second probe 130*b* remain in preferably continuous and uninterrupted contact with the contact area 150*a* and the contact area 150*b*, respectively. Moreover, as shown in FIG. 1*a*, the first probe 130*a* can be aligned with the axis of rotation of the first field device housing arrangement 110, and the second probe 130*b* can be offset from the axis of rotation of the first field device housing arrangement 110. Alternatively, as shown in FIG. 5*a*, in a second exemplary embodiment of the present invention, the first probe 130*a* and the second probe 130*b* can each be offset from the axis of rotation of the first field device housing arrangement 110.

The first field device housing arrangement 110 initially may be connected to the second field device housing arrangement 120, such that the display 180 may be located at an initial position which is relative to the second field device housing arrangement 120. When the assembly 100 is being installed at a predetermined location, it may be desirable to change the initial position of the display 180 relative to the second field device housing arrangement 120, such that the display can more readily be viewed by the user. In order to change the position of the display 180, the user can insert the tool element into the bore formed in the cap member 195, and loosen the securing element 190 (e.g., by rotating the securing element 190 in the predetermined direction). When the securing element 190 is loosened, the tip 190*a* of the securing element 190 may begin to disengage from the predetermined portion 135. As described above, the portion of the tip 190*a* of the securing element 190 may not be removed from the recess 120*a*. The user then can rotate the first field device housing arrangement 110 relative to the second field device housing arrangement 120 until the display screen 180 is at a desired position which is relative to the second field device housing arrangement 120.

During this rotation of the first field device housing arrangement 110 with respect to the location of the second field device housing arrangement, the first probe 130*a* and the second probe 130*b* also may rotate with respect to the contact areas 150*a*, 150*b*. For example, when the first probe 130*a* is aligned with the axis of rotation of the first field device housing arrangement 110, the first probe 130*a* may rotate about the axis of rotation of the first field device housing arrangement 110. As shown in FIG. 1*a*, a position of the first probe 130*a* with respect to the axis of rotation preferably does not change during the rotation of the first field device housing arrangement 110. Nevertheless, when the first probe 130*a* and/or the second probe 130*b* are not aligned with the axis of rotation of the first field device housing arrangement 110 as shown in FIG. 5*a*, the first probe 130*a* and/or the second probe 130*b* may rotate along an are having a radius which equals to a distance from the first probe 130*a* and/or the second probe 130*b* and the axis of rotation of the first field device housing arrangement 110. PARA0In FIG. 5*b*, the contact areas 150*a*, 150*b* are electrically insulated from one another and/or provided at a distance from each other. The surface area of the contact area 150*a* and/or the contact area 150*b* may be sized such that throughout the rotation of the first field device housing arrangement 110, the first probe 130*a* and/or the second probe 130*b* remain in continuous and uninterrupted contact with the contact area 150*a* and/or the second contact area 150*b*, respectively. Consequently, during the relative rotation of the first field device housing arrangement 110, the first electrical system remains electrically coupled to the second electrical system via the first probe 130*a* and/or the second probe 130*b*. Moreover, pursuant to such rotation and after the display screen 180 reaches the desired position which is relative to the second field device housing arrangement 120, the securing element 190 may be tightened (e.g., by rotating the securing element 190 in the direction which is opposite the predetermined direction) to re-secure the first field device housing arrangement 110 to the second field device housing arrangement 120. PARA0It will be understood by those of ordinary skill in the art that the assembly 100 can be used in locations which may have hazardous environments. For example, the assembly 100 can safely function when exposed to explosive gases and/or fluids. Moreover, the assembly 100 preferably satisfies the standards as set forth in the "Intrinsically Safe Apparatus and Associated Apparatus for use in Class I, II, and III, Division 1 Hazardous (Classified) Locations," authored by Factory Mutual Research Corporation of Norwood, Mass., the entire disclosure of which is incorporated herein by reference. For example, the electronics housing arrangement 110 and the sensor housing arrangement 120 have a flame proof path which is sustained during installation and operation. PARA0FIG. 6 shows a flow diagram of an exemplary embodiment of a method 600 according to the present invention which can be used to secure the assemblies 100 of FIG. 1*a* and/or FIG. 5*a*. In step 610, the securing element 190 may be loosened from the first field device housing arrangement 110. For example, the securing element 190 can be loosened by rotating the securing element 190 in the predetermined direction. In step 620, the continuous and non-interruptible electrical coupling is maintained between the first electrical system and the second electrical system while unrestrictedly rotating the first field device housing arrangement 110 relative to the second field device housing arrangement 120. For example, the first end of the first probe 130*a* and/or the first end of the second probe 130*b* may be affixed to the first electrical system (e.g., to the first circuit fixture 140). Similarly, the second end of the first probe 130*a* and/or the second end of the second probe 130*b* may be electrically coupled to (e.g., brought into contact with) the second electrical system (e.g., to the second circuit fixture 150). Moreover, in step 630, the first field device housing arrangement 110 is secured to the second field device housing arrangement 120 after the first field device housing arrangement 110 reaches a predetermined position relative to the second field device housing arrangement 120. For example, the securing element 190 can be rotated in the direction which is opposite to the predetermined direction. PARA0While the invention has been described in connecting with preferred embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein. It is intended that the specification and the described examples are considered as exemplary only, with the true scope and spirit of the invention indicated by the following claims.

What is claimed is:

1. An assembly, comprising:

a first field device housing arrangement associated with a first electrical system;

a second field device housing arrangement associated with a second electrical system; and a connector arrangement configured to allow an unrestricted rotation of the first field device housing arrangement relative to the second field device housing arrangement while maintaining a continuous electrical coupling between the first electrical system and the second electrical system, the connector arrangement comprising a locking system configured to fix the first field device housing arrangement to the second field device housing arrangement, wherein the locking system comprises:

at least one securing element adapted to secure the first field device housing arrangement to the second field device housing arrangement, and including a head portion, and a cap element adapted to cover at least one portion of the securing element, wherein the cap element includes a bore formed therethrough, and wherein a cross-sectional area of the bore is less than a cross-sectional area of the head portion of the at least one securing element.

2. The assembly of claim 1, wherein the at least one securing element is one of a screw and a bolt.

3. The assembly of claim 1, wherein the at least one securing element comprises at least one portion adapted to prevent the second field device housing arrangement from being entirely detached from the first field device housing arrangement.

4. The assembly of claim 3, wherein the connector arrangement is configured to allow the unrestricted rotation of the first field device housing arrangement relative to the second field device housing arrangement when the at least one securing element is loosened by rotating the at least one securing element in a predetermined direction.

5. A method of securing an assembly which includes a first field device housing arrangement associated with a first electrical system, a second field device housing arrangement associated with a second electrical system, and a connector arrangement configured to secure the first field device housing arrangement to the second field device housing arrangement, the method comprising:

maintaining a continuous electrical coupling between the first electrical system and the second electrical system while enabling an unrestricted rotation of the first field device housing arrangement relative to the second field device housing arrangement; and securing the first field device housing arrangement to the second field device housing arrangement after the first field device housing arrangement reaches a predetermined position relative to the second field device housing arrangement, the connector arrangement comprising a locking system configured to fix the first field device housing arrangement to the second field device housing arrangement, wherein the locking system comprises:

at least one securing element adapted to fix the first field device housing arrangement to the second field device housing arrangement, and including a head portion, and a cap element adapted to cover at least one portion of the securing element, wherein the cap element includes a bore formed therethrough, and wherein a cross-sectional area of the bore is less than a cross-sectional area of the head portion of the at least one securing element.

6. The method of claim 5, wherein the at least one securing element is one of a screw and a bolt.

7. The method of claim 5, wherein the at least one securing element comprises at least one portion adapted to prevent the second field device housing arrangement from being entirely detached from the first field device housing arrangement.

8. The method of claim 7, further comprising the step of rotating the at least one securing element in a predetermined direction to allow the unrestricted rotation of the first field device housing arrangement relative to the second field device housing arrangement.

* * * * *